United States Patent [19]

Nakamura

[11] Patent Number: 4,961,516

[45] Date of Patent: Oct. 9, 1990

[54] PROCESSING SOLUTION CONTAINER

[75] Inventor: Takashi Nakamura, Minami-ashigara, Japan

[73] Assignee: Fuji Photo Film Co., Ltd., Kanagawa, Japan

[21] Appl. No.: 322,942

[22] Filed: Mar. 14, 1989

[30] Foreign Application Priority Data

Mar. 16, 1988 [JP] Japan ..... 63-62625

[51] Int. Cl.[5] ..... B65D 37/00

[52] U.S. Cl. ..... 222/94; 222/103; 222/107; 222/145; 222/213

[58] Field of Search ..... 222/92, 94, 107, 129, 222/145, 103, 95, 206, 212, 213, 215, 541; 220/22; 215/6

[56] References Cited

U.S. PATENT DOCUMENTS

| | | | |
|---|---|---|---|
| 2,001,819 | 5/1935 | Elle et al. | 222/145 X |
| 3,012,695 | 12/1961 | Lerner | 222/129 |
| 3,335,912 | 8/1967 | Reeves, Jr. | 222/94 |
| 3,442,424 | 5/1969 | Prussin et al. | 222/94 X |
| 3,659,749 | 5/1972 | Schwartz | 222/145 |
| 4,062,477 | 12/1977 | Morane | 222/145 |
| 4,089,437 | 5/1978 | Chutter et al. | 222/94 |
| 4,676,406 | 6/1987 | Frischmann et al. | 222/145 X |
| 4,808,006 | 2/1989 | Kaufeler | 222/145 X |

FOREIGN PATENT DOCUMENTS

| | | | |
|---|---|---|---|
| 5234973 | 1/1977 | Australia . | |
| 1957163 | 12/1966 | Fed. Rep. of Germany . | |
| 2758017 | 7/1979 | Fed. Rep. of Germany | 222/145 |
| 2809646 | 9/1979 | Fed. Rep. of Germany | 222/145 |
| 3644483 | 7/1988 | Fed. Rep. of Germany | 222/145 |
| 6345555 | 3/1988 | Japan . | |

*Primary Examiner*—H. Grant Skaggs
*Assistant Examiner*—Boris Milef
*Attorney, Agent, or Firm*—Sughrue, Mion, Zinn, Macpeak & Seas

[57] ABSTRACT

A processing solution container is provided which can contain two or more fluids separately. The container includes an expandable housing for receiving processing solution therein having a port for charging and discharging the solution, and a partition in the housing for dividing the interior of the housing into a plurality of compartments, but allowing fluid communication between the compartments when the housing is expanded.

7 Claims, 11 Drawing Sheets

PROCESSING SOLUTION CONTAINER

BACKGROUND OF THE INVENTION

This invention relates to a processing solution container. More particularly, it pertains to processing solution containers for use in a photographic developing machine as supply tanks for supplying various processing solutions such as developing, breaching and fixing solutions to corresponding processing troughs.

In general, prior art containers commonly used for containing various processing solutions are rigid undeformable containers because they must be durable and impact resistant to meet storage and transportation requirements.

Some processing solutions are shelf stored in concentrate form for storage considerations and used by diluting with a proper amount of diluent to the desired concentration. In this situation, in order to prevent deterioration of the solution as by oxidation, the container is fully filled with the concentrate such that no air space is left in the container interior. Since the container has a fixed shape as described above, the concentrate must be taken out of the container into another container of a larger volume before it can be diluted.

I proposed one solution to eliminate such cumbersome diluting operation in Japanese Utility Model Application No. 61-138827 (Kokai No. 63-45555 laid open Mar. 28, 1988). A processing solution container is disclosed as comprising a compressible housing which is compressed and filled with a processing solution concentrate in sealed condition upon storage and transportation, but is expanded to a predetermined interior volume upon use. Then a diluent is poured into the housing to a predetermined level to give a processing solution of a predetermined concentration.

Some photographic processing solutions are stored in two parts or more and used by mixing them. For example, developing, bleaching or fixing solution used in wet photographic development is usually stored as first and second parts both in concentrate form and used by mixing the first and second parts and adding a diluent, typically water thereto. The first and second parts are separately stored partially because the solution is of the type that will deteriorate if it is stored as a mixture of two parts and partially because a great volume is required in order that a mixture of two parts be a solution if two parts are mutually less compatible.

In the situation where a plurality of parts are mixed to form a processing solution on use, the processing solution container of the above-mentioned application has a disadvantage that a corresponding plurality of containers are necessary to store solution parts separately. To set these containers in the processing solution supply station of a photographic developing machine, a space corresponding to the number of containers is required, undesirably increasing the size of the developing machine.

The processing solution container of the above-mentioned application is easy to dilute the concentrate contained therein, but difficult to mix two or more concentrates in the single container.

SUMMARY OF THE INVENTION

An object of the present invention is to provide a processing solution container which can receive two or more different solutions therein separately.

Another object of the present invention is to provide a processing solution container which can receive two or more different parts of processing solution therein separately and allow the different parts to be mixed to form the desired solution within the container.

According to the present invention, there is provided a processing solution container comprising an expandable housing for receiving processing solution therein having an opening for passage the solution, and means associated with the housing for dividing the interior of the housing into a plurality of compartments, but allowing fluid communication between the compartments when the housing is expanded.

Preferably, the dividing means comprises a partition, more preferably a partition which is breakable upon expansion of the housing to allow fluid communication between the compartments.

Alternatively, the dividing means comprises partition members which are engaged to form a fluid seal, but are slidingly separated upon expansion of the housing.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiments which are given by way of example with the accompanying drawings, in which:

DESCRIPTION OF THE PREFERRED EMBODIMENTS

Figure 1A:
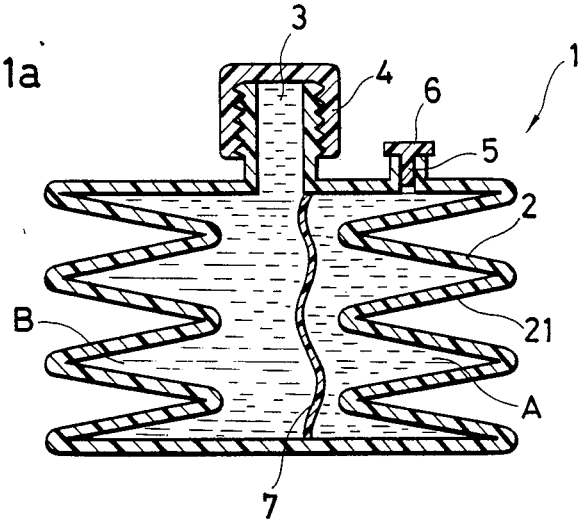
FIGS. 1*a* and 1*b* are schematic cross-sectional views of the processing solution container according to a first embodiment of the present invention in compressed and expanded states, respectively.

Referring to FIGS. 1 through 5, there are illustrated processing solution containers according to different embodiments of the present invention. A processing solution container which is generally designated at 1 is illustrated as comprising a housing 2 for receiving fluid or processing solution therein. The housing 2 is expandable or collapsible. In one preferred embodiment, the housing 2 is a generally columnar housing including a bellows barrel 21, a bottom wall, and a top wall, which are preferably molded from a resin composition as a one-piece member, or as separate segments subsequently joined, to define a closed chamber therein. The bellows barrel 21 is axially expandable in this embodiment. In order that the housing 2 be expandable, the housing is not limited to the bellows type. The transverse cross section of the housing may be of any desired shapes including rectangular and circular shapes.

The housing 2 includes an outlet port 3 for discharging the fluid from the container. The outlet port 3 is preferably disposed at the center of the housing top wall and more preferably integrally formed with the housing. A cap 4 is threadably engaged on the outlet port 3 to seal the interior of the housing, that is, shutting off the processing solution in the container from the ambient atmosphere.

The material of which the housing 2 is made is preferably flexible, resistant to water, and resistant to the processing solution, that is, chemical resistant. The flexible chemical resistant material used to form the housing includes various resins, for example, polypropylene, polyethylene, and polybutylene, but is not limited thereto. It is also preferred that the housing material is transparent or semi-transparent because solution volume, partition rupture or any other changes in the housing can be visually observed from the outside.

The characterizing feature of the present invention is the provision of means associated with the housing for dividing the interior of the housing into a plurality of compartments, but allowing fluid communication between the compartments when the housing is expanded. More particularly, a partition is disposed in the housing to divide the housing interior into two or more compartments which can be charged with different parts of processing solution for storage. Several structural embodiments of the partitioning means are illustrated in detail.

In the embodiment of FIG. 1, a partition or diaphragm 7 extends approximately axially through the housing interior between the top and the bottom walls of the housing 2 as shown in FIG. 1*a*. The partition 7 divides the housing interior into first and second compartments A and B. The volumes of two compartments may be determined depending on the intended use.

As seen in FIG. 1*a*, the first and second compartments A and B are approximately full of different types of fluid. The fluids contained herein will be described later. It is to be noted that the second compartment B is in communication with the outlet port 3. Processing solution may be admitted into the second compartment B through the port 3.

The housing 2 includes an inlet port 5 for admitting processing solution into the first compartment A. The inlet port 5 is disposed at a shoulder or side portion of the top wall of the housing in the illustrated embodiment. A plug 6 is engaged with the inlet port 5 to form a seal against the processing solution in the first compartment A. With the solutions filled and the cap and plug closed, the container is ready for storage.

Figure 1B:
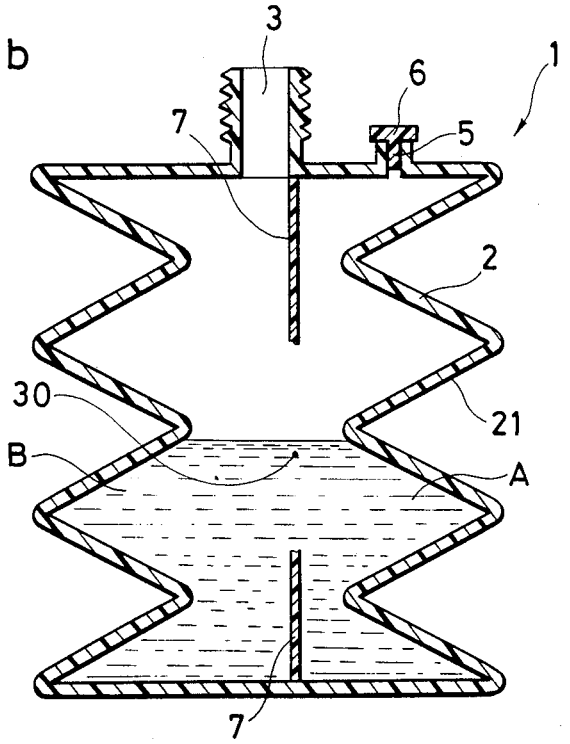

The material of which the partition 7 is made must be impermeable and chemically resistant to processing solution. In addition, the partition is breakable under tension when the housing 2 is axially expanded as shown in FIG. 1*b*. Examples of the fluid impermeable, chemically resistant, rupturable material include films of various resins such as polyvinylidene chloride, polypropylene and polyethylene, and wax-coated paper and the like. The thickness of the partition 7 varies over a wide range depending on the type and strength of the partition material and may be determined so as to provide a compromise between the strength or durability necessary during solution storage and the ease of rupture or rupture strength at which the partition is broken. Preferred, but non-limiting examples of the partition include films of polyvinylidene chloride having a thickness of about 80 μm and a rupture strength of about 3 kg-cm/cm. To provide for ease of rupture or to rupture the partition at a selected portion, the partition 7 may be provided at a predetermined position with means for facilitating rupture in the form of a notch or an adhesively bonded overlap between two film members (not shown).

The partition may be bonded to the housing by any desired methods including fusion welding and adhesive bonding. Alternatively, the housing may be formed from a plurality of housing segments. A partition is bonded to each of the housing segments and thereafter, the segments are combined together. In either case, bonding may be achieved by adhesive bonding, heat sealing, or any other sealing techniques.

On use, as shown in FIG. 1*b*, the housing 2 is expanded until the partition 7 is broken. Rupture provides an opening 30 through which the first and second compartments A and B are in fluid communication so that the solutions may be mixed with each other.

Figure 2A:
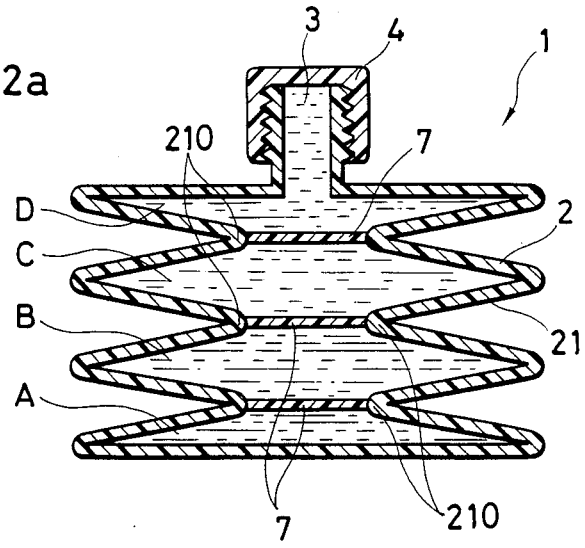
FIGS. 2*a* and 2*b*, 3*a* and 3*b*, 4*a*, 4*b* and 4*c*, and 5*a*, 5*b* and 5*c* are views similar to FIGS. 1*a* and 1*b*, but showing different embodiments of the present invention.
Figure 2B:
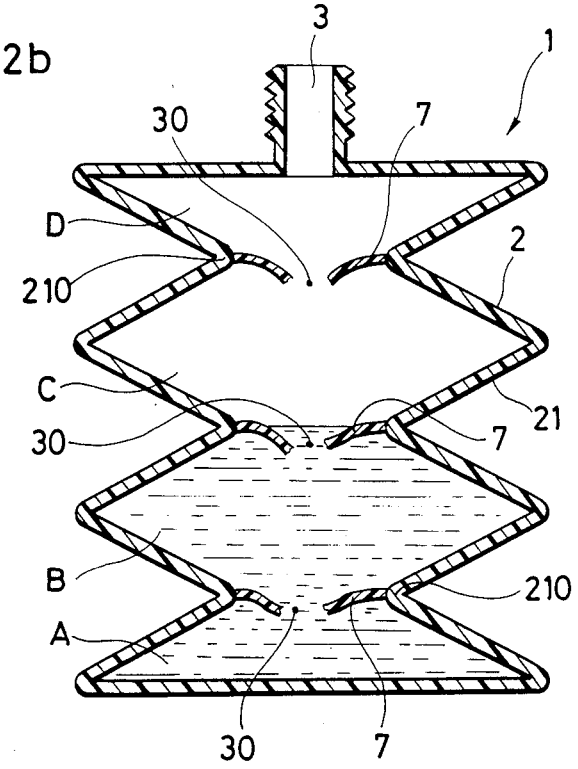

In the second embodiment shown in FIG. 2, a plurality of partitions 7 horizontally extend between opposed inward folds 210 of the bellows barrel 21 of the housing 2 as shown in FIG. 2*a*. In the illustrated embodiment, three transverse partitions 7 divide the housing interior into first, second, third and fourth compartments A, B, C, and D from below. The material and nature of these partitions are as described in the first embodiment.

On use, the housing is axially expanded and the distance between opposed inward edges 210 of the bellows barrel 21 is accordingly increased to break the partitions 7.

In the container of the second embodiment, processing solution parts may be introduced into the respective compartments by admitting a first part into the first compartment A through the port 3, extending the lowermost partition, then admitting a second part into the second compartment B through the port 3, extending the intermediate partition, then admitting a third part into the third compartment C through the port 3, extending the uppermost partition, then admitting a fourth part into the fourth compartment D through the port 3, and finally engaging the cap 4 on the port 3. The port 3 is large enough for access. No special inlet port for the processing solution is necessary in the housing 2 of the embodiment of FIG. 2. However, the housing 2 may be provided with inlet ports in communication with the respective compartments A, B, and C. Such inlet ports may be formed in the bellows barrel 21, for example.

Figure 3A:
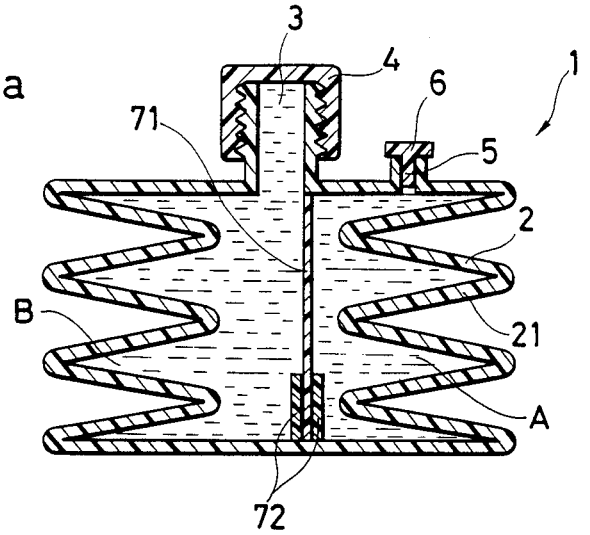
Figure 3B:
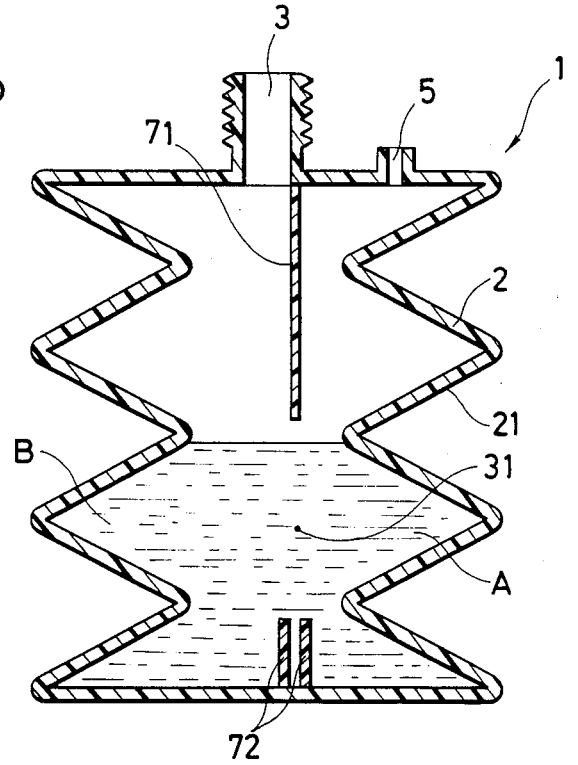

In the third embodiment shown in FIG. 3, the dividing means is different from that of the preceding embodiments. The dividing means includes a generally planar slide member 71 which is secured to the top wall of the housing 2 and approximately axially suspended therefrom and a pair of guide members 72, 72 which are secured to the bottom wall of the housing 2. As seen in FIG. 3*a*, a lower portion of the slide member 71 is inserted between the guide members 72, 72 in close contact when the housing 2 is in compressed state. The mated slide and guide members forms a partition which divides the housing interior into first and second compartments A and B while the close contact between the members maintains fluid tight separation.

On use, as the housing 2 is axially expanded, the slide member 71 is slidably separated from the guide members 72, 72 to provide an opening 31 through which the first and second compartments A and B are in fluid communication so that the solutions may be mixed.

In this embodiment, a communicating opening is formed simply by moving the slide member 71 apart from the guide members 72, 72. Alternatively, the slide member 71 and the guide members 72, 72 may be provided with apertures. These apertures are disposed such that the apertures in the slide member 71 do not register with the apertures in the guide members 72 when the housing 2 is contracted, but the apertures in the slide member 71 register with the apertures in the guide members 72 to allow fluid communication between compartments A and B when the housing 2 is stretched.

The material of which the slide and guide members are made must be impermeable and chemically resistant to processing solution. In addition, the members must form a fluid seal when they are engaged as shown in FIG. 3*a*. Examples of the chemically resistant material include plates of various resins such as polyvinylidene chloride, polypropylene, polyethylene, and the like. The thickness of the members varies over a wide range depending on the type and strength of the material and may be determined so as to provide the strength or durability necessary during solution storage. Preferred, but non-limiting examples of the members include plates of polypropylene having a thickness of about 40 μm and a tensile strength of about 250 g/cm$^2$. To assist in the fluid tight seal between the engaging members, a suitable sealant may be applied, for example, silicone fluid.

A fourth embodiment is shown in FIG. 4. The dividing means include partitions or diaphragms 73 and 74 which partition the housing interior into first, second and third compartments A, B, and C. The partitions extends approximately axially of the housing and are substantially the same as that described in the first embodiment. In the embodiment of FIG. 4, one partition 74 is longer than the other partition 73 in an axial or expansion direction of the housing. Thus, the one partition 74 is loose and the other partition 73 is rather tight.

The housing 2 includes inlet ports 5 for admitting processing solution into the first and second compartments A and B. Each inlet port 5 is disposed at a shoulder or side portion of the top wall of the housing in the illustrated embodiment. A plug 6 is engaged with each inlet port 5 to form a seal against the processing solution in the corresponding compartment. With the solutions filled and the cap and plugs closed, the container is ready for storage.

Figure 4A:
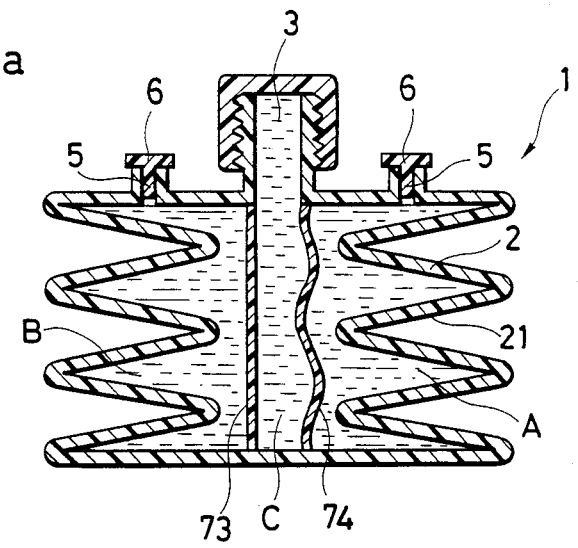
Figure 4B:
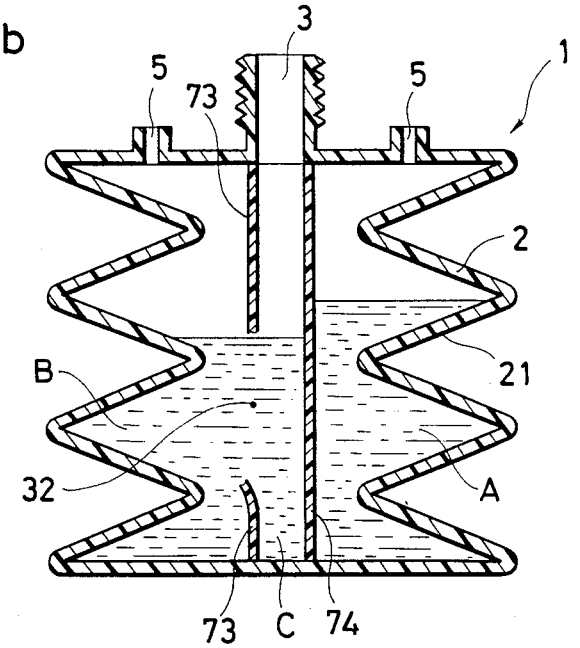
Figure 4C:
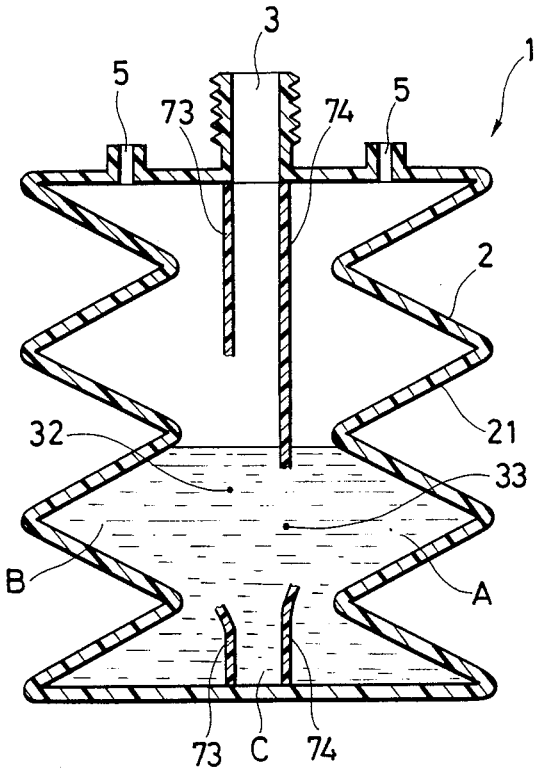

On use, the housing 2 is first expanded until the shorter partition 73 is broken as shown in FIG. 4*b*. At this point, an opening 32 is formed in the partition 73 to allow the solution in the second compartment B to mix with that in the third compartment C. It is to be noted that the resulting solution of two parts is ready for use at this point or after dilution if necessary. The housing 2 may be further expanded until the longer partition 74 is broken as shown in FIG. 4*c*. At this point, another opening 33 is formed in the partition 74 to allow fluid communication among all the compartments, that is, mixing of three solution parts.

A fifth embodiment is shown in FIG. 5. This processing solution container has the same function as that of FIG. 4, but a different partition structure. The partition structure is substantially the same as in the embodiment of FIG. 3.

Two sets of shorter and longer guide members 75, 75 and 76, 76 are secured to the bottom wall of the housing 2. Two slide members 71 and 71 are secured to the top wall of the housing and extended axially downward until they are inserted into the corresponding sets of guide members to form fluid tight seals.

Figure 5A:
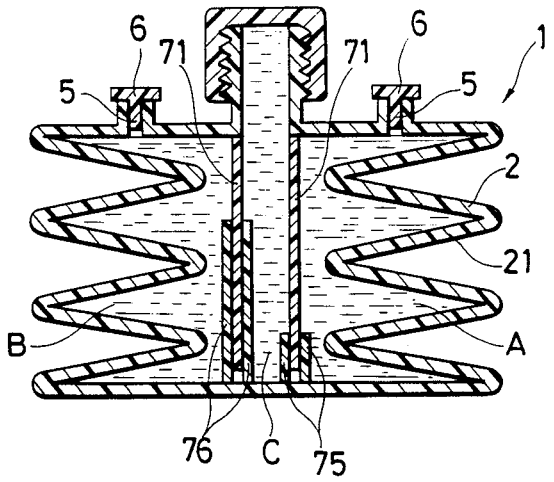
Figure 5B:
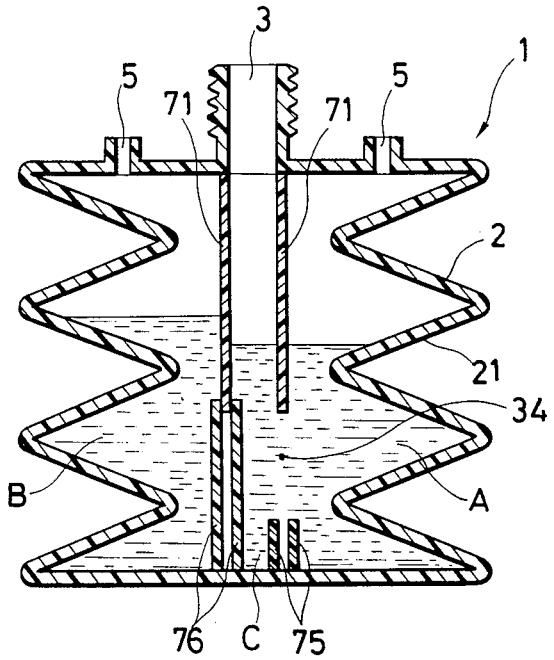
Figure 5C:
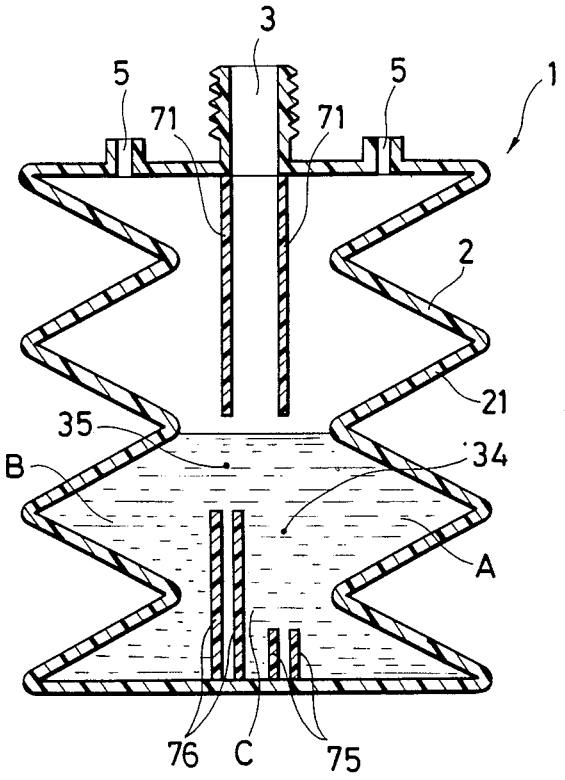

On use, the housing 2 is first expanded until one slide member 71 is separated from the shorter guide members 75 as shown in FIG. 5*b*. At this point, an opening 34 is formed to allow the solution in one compartment A to mix with that in the central compartment C. It is to be noted that the resulting solution of two parts is ready for use at this point or after dilution if necessary. The housing 2 may be further expanded until the other slide member 71 is separated from the longer guide members 76 as shown in FIG. 5*c*. At this point, another opening 35 is formed to allow fluid communication among all the compartments, that is, mixing of three solution parts.

Instead of disengaging the slide member from the guide members to form a communicating opening, the slide and guide members may be provided with apertures which come in alignment to form a communicating flowpath when the housing is expanded as previously described.

In the processing solution containers according to the fourth and fifth embodiments of FIGS. 4 and 5, three or more parts of processing solution may be mixed in a particular order. It is also possible to mix only selected ones of the processing solution parts.

Figure 6:
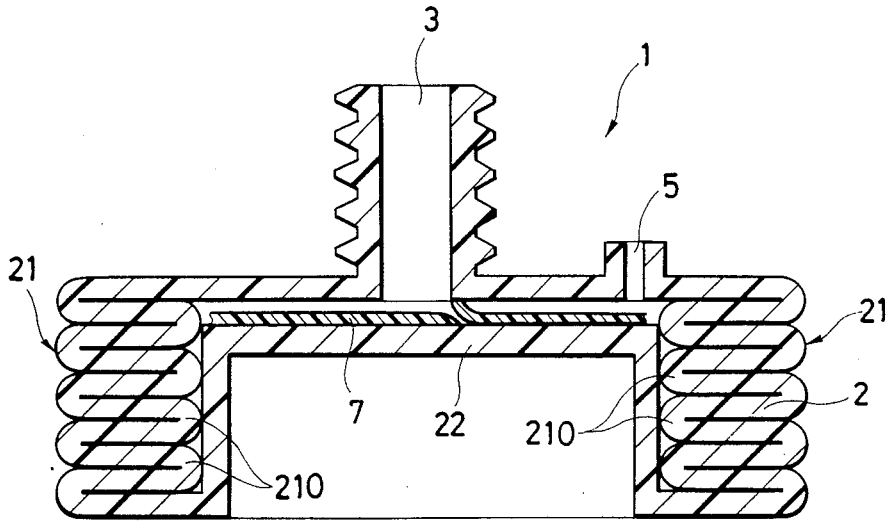
FIG. 6 is a schematic cross-sectional view of a container according to a further embodiment of the present invention in fully compressed state.

When the processing solution is taken out of the container, it is generally desirable to fully empty the container of the solution. For this purpose, the once expanded housing may be compressed again to force the solution out of the container. Preferably, the housing is designed such that the interior volume of the fully compressed housing or minimum volume is about 1/5 to about 1/200 of the interior volume of the fully expanded housing or maximum volume. One exemplary configuration for achieving such a great difference between the minimum and maximum volumes is shown in FIG. 6. In this configuration, the housing 2 at its bottom wall is provided with a recess 22 which projects inward of the housing. The recess 22 is dimensioned such that it closely conforms to the inside cavity defined by the compressed bellows barrel 21 and the top wall as shown in FIG. 6. Provided that the housing 2 is fully collapsed, the recess has an axial distance approximately equal to the total thickness of folds of the bellows barrel 21 and a transverse distance approximately equal to the distance defined by the inward edges of the bellows folds. Then almost all the solution can be taken out of the container.

The proportion of the normal volume of the moderately compressed housing to the maximum volume of the fully expanded housing may be determined depending on the type of solution contained, more particularly the percent dilution of a concentrate to a processing solution.

The fluid parts which are received in compartments A to B or to D divided by the partition or partitions are not critical to the present invention. A formulation necessary to provide a photographic developing or bleach/fixing solution may be separated into two or more parts by properly combining base solution, diluent and additives. The diluent may be purified water having optional additives added thereto.

It is preferred that the compartments are filled with a full volume of solution without leaving air when the housing 2 is in normally compressed state or solution storage state as shown in FIGS. 1*a*, 2*a*, 3*a*, 4*a* and 5*a*. If the solution is in contact with air during storage, it is prone to degradation or deterioration as by oxidation or the like. If a compartment is not filled with solution to a full volume, the resulting empty space should preferably be filled with an inert gas such as nitrogen and argon gases.

Figure 7:
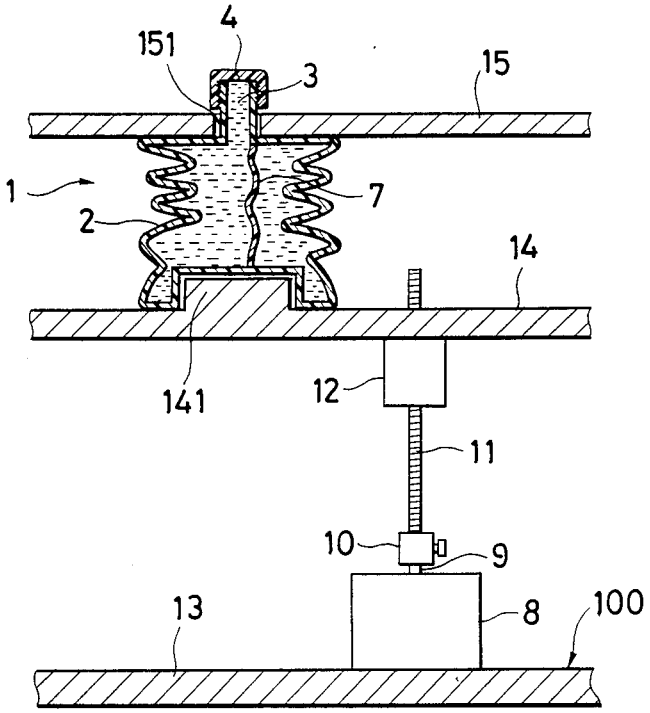
FIGS. 7, 8 and 9 illustrate an arrangement for mounting the container of the present invention to controlledly expand or compress the container, FIG. 7 showing a normal state full of solution, FIG. 8 showing an expanded state, and FIG. 9 showing pumping of the solution.
Figure 8:
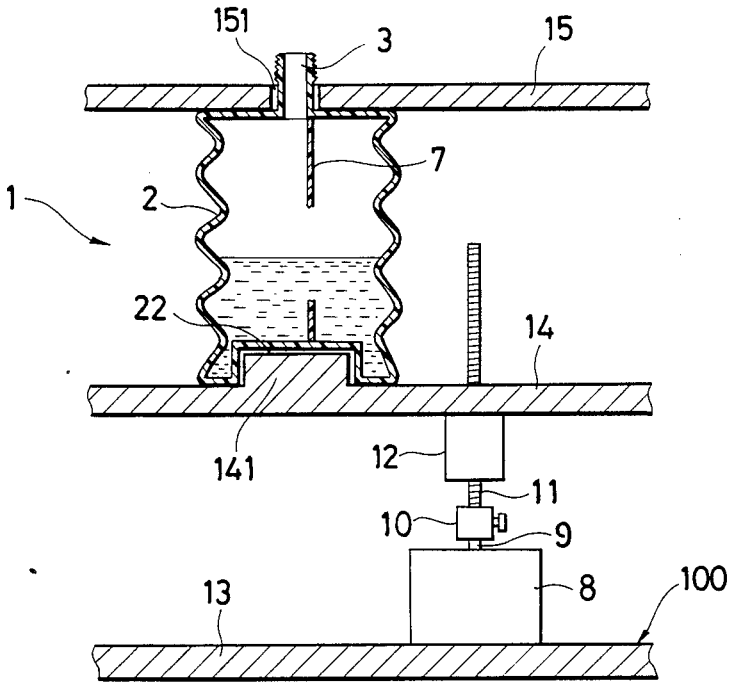
Figure 9:
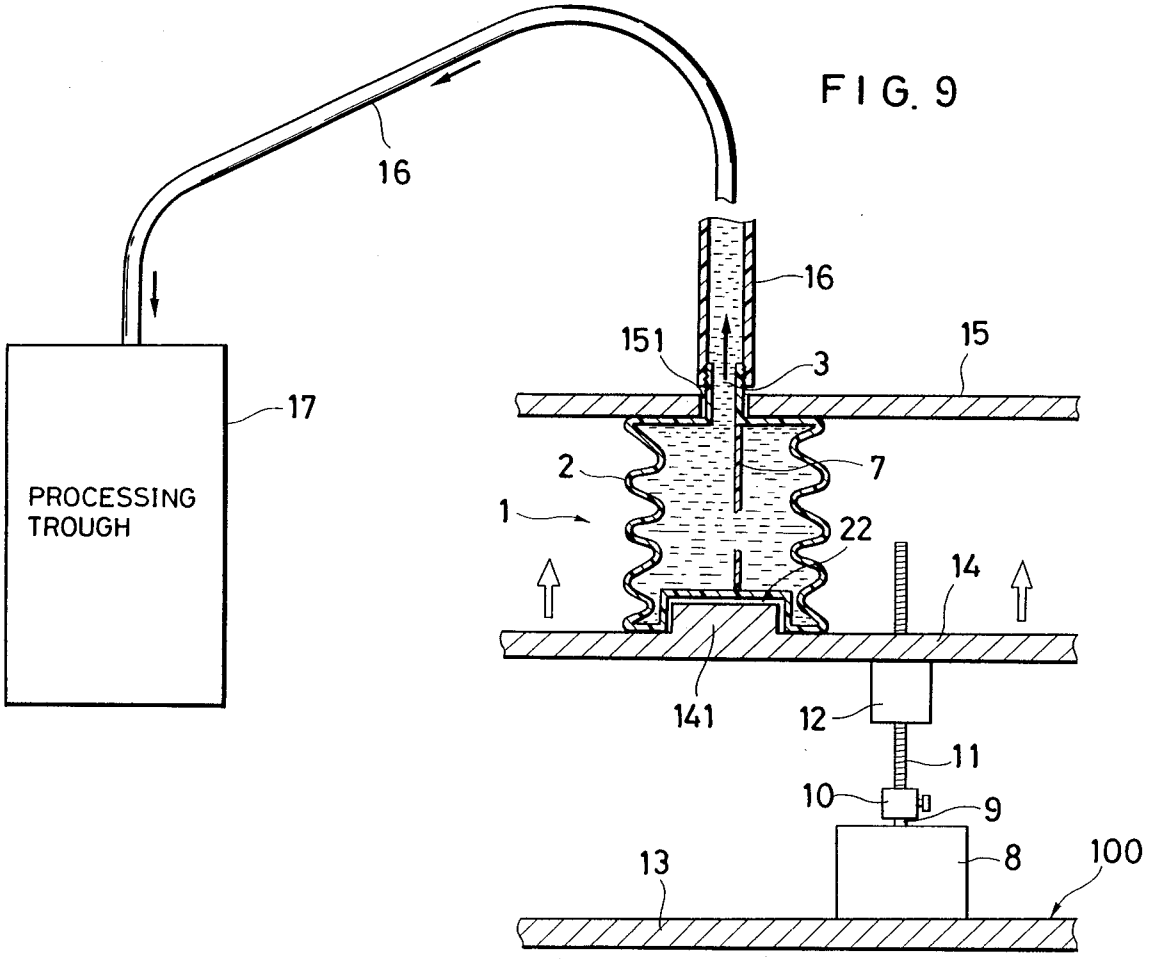

On use, the processing solution container according to the present invention is preferably mounted in a mechanism for controlledly operating the container. FIGS. 7 through 9 show a typical arrangement for mounting the processing solution container in place to control the degree of expansion of the container.

The mount arrangement generally designated at 100 is illustrated as comprising a base 13, a movable plate 14, and a stationary plate 15, all set substantially in parallel. The arrangement also includes means for driving the movable plate 14. The drive means includes a drive source in the form of a motor 8 secured on the base 13 and having a rotating shaft 9 to which a threaded bar 11 is connected via a coupling 10. The threaded bar 11 is in engagement with a nut 12 which is secured to the movable plate 14. When the motor 8 is actuated, the bar 11 is rotated to urge the nut 12 and the movable plate 14 in an axial direction of the bar 11. As a result, the distance between the movable and stationary plates 14 and 15 is controlledly changed.

The container 1 or housing 2 is mounted between the movable and stationary plates 14 and 15 with the housing bottom and top walls secured to the movable and stationary plates 14 and 15. Suitable holders may be used although they are not shown in the figures. The housing 2 is expanded or contracted as the distance between the movable and stationary plates 14 and 15 is increased or decreased.

The housing 2 has the inward recess 22 on the bottom wall. The movable plate 14 has a raised seat 141. The housing 2 is mounted in place through the engagement between the recess 22 and the seat 141. In this position, the outlet port 3 projecting upward from the housing top wall extends through an opening 151 in the stationary plate 15.

The operation of the above-mentioned arrangement is described below.

First, the container 1 full of necessary parts of processing solution is mounted in place between the movable and stationary plates 14 and 15 as shown in FIG. 7.

The cap 4 and the plug 6 (not shown in FIG. 7) are disengaged from the outlet port 3 and the inlet port 5. The motor 8 is then actuated to rotate the bar 11 in a predetermined direction to move the movable plate 14 downward to expand the housing 2 as shown in FIG. 8. As the housing is axially expanded, the partition 7 is broken to allow the separated fluid parts to mix into a solution and the internal volume of the housing is increased. Ambient air flows into the housing in a volume equal to an increment of the housing internal volume through the ports 3 and 5.

Then an appropriate diluent is introduced into the housing 2 through the port 3 until the resulting solution reaches approximately the full volume of the expanded housing.

Next, a transfer conduit 16 is connected at one end to the outlet port 3 of the housing and at the other end to a processing trough 17 which may be a developing or bleach/ fixing trough. The motor 8 is actuated to rotate the bar 11 in the reverse direction to move the movable plate 14 upward at a predetermined rate, slowly collapsing the housing 2. As the housing 2 is contracted, the processing solution is fed from the container 1 to the processing trough 17 through the conduit 16. The flow rate at which the solution is transferred from the container 1 to the trough 17 is determined by the rotation of the motor 8.

After the movable plate 14 is raised to the uppermost level at which the container is substantially emptied of the processing solution, the motor is again actuated in the forward direction to move down the movable plate 14. The emptied container is replaced with a new container full of solution. The foregoing operation is then repeated.

It is possible to place a plurality of processing solution containers of the same or different shape between the movable and stationary plates 14 and 15 in parallel or series relationship so that all the containers are pumped at the same time. This enables simultaneous supply of processing solutions from a plurality of containers (for example, a developing tank and a bleach/fix tank) to a single or plural processing troughs (for example, a developing trough and a bleach/fix trough).

Although the processing solution container of the present invention is expanded and collapsed by means of the mount arrangement 100, the container may be operated by any other mechanisms or manually.

Although the processing solution container of the present invention is described as being applicable to developing or bleach/fix solution tank used in a photographic developing machine, the application of the container is not limited thereto. The present container will find effective use in a wide variety of applications.

EXAMPLE

An example of the container of the present invention is given below by way of illustration and not by way of limitation.

The processing solution used in Example was a developing solution which consisted of part I, alkaline solution and part II, developing agent solution.

A processing solution container as shown in FIG. 1 was prepared by molding polyethylene into a bellows housing having outer dimensions of 12 cm×12 cm×10 cm and a wall thickness of 350 μm. The housing had an initial inner volume of 660 ml in normal folded state and a maximum volume of 4770 ml when expanded. The partition used was a film of polyvinylidene chloride having a size of 10 cmμ12 cm, a thickness of 40 μm and a rupture strength of 1.5 kg-cm/cm. The film was sealingly bonded to opposed inside walls and the bottom wall of the bellows housing using a rubber adhesive.

Parts I and II were introduced into compartments A and B through the ports 5 and 3. With the ports closed with the cap and plug, the container was allowed to stand for 600 days at 25° C.

The housing was expanded until the film was broken. The force required to expand the housing and break the film was approximately 900 g-cm/cm, which force could be easily given manually or by a suitable mechanical expanding mechanism, for example, as shown in FIGS. 7-9.

The mixture was diluted to the full volume of the expanded housing by adding water. The resulting solution was found to be effective.

The processing solution container of the present invention has the advantage that two or more different fluids may be separately received in a single container and they can be readily mixed when it is desired to use the solution. Also, the resulting mixture may be readily diluted in the container. Since the processing solution concentrates can be contained in the container without contact with air, the container prevents any deterioration or degradation of the processing solution during shelf storage.

When the processing solution container is mounted in an expansion control apparatus, mixing of solution parts, dilution of the mixture, and pumping of the diluted solution can be easily carried out in a precise manner. The arrangement is also advantageous for automatic operation.

Obviously, numerous modifications and variations of the present invention are possible in light of the above teachings. It is therefore to be understood that within the scope of the appended claims, the invention may be practiced otherwise than as specifically described herein.

I claim:

1. A processing solution container comprising an integrally-formed expandable housing, having a single exterior wall, for receiving processing solution therein and being operative between at least a first state in which said housing is compressed and at least one second state in which said housing is expanded;

means associated with the housing for dividing the interior of the housing into a plurality of compartments, said dividing means sealing against fluid communication between said compartments when said housing is in said first state, and wherein expanding said housing to said at least one second state breaks said seal to allow fluid communication between at least two of said compartments.

2. The container of claim 1 wherein said dividing means comprises at least one partition.

3. The container of claim 2 wherein said dividing means comprises a partition which is breakable upon expansion of the housing to allow fluid communication between said at least two compartments.

4. The container of claim 1 wherein said dividing means comprises at least two partition members which are engaged to form a fluid seal, but are slidingly separated upon expansion of the housing.

5. The container of claim 2 wherein said dividing means is operative to divide said interior of said housing into at least three compartments and to allow selective fluid communication of said compartments as said housing expands into a plurality of said second states.

6. The container of claim 4 wherein said dividing means is operative to divide said interior of said housing into at least three compartments and to allow selective fluid communication of said compartments as said housing expands into a plurality of said second states.

7. The container of claim 1 wherein said housing further comprises at least one opening for passage of a fluid.

* * * * *